US009339083B2

(12) United States Patent
Benetti et al.

(10) Patent No.: US 9,339,083 B2
(45) Date of Patent: May 17, 2016

(54) SKI BOOT BUCKLE FOR CLOSING THE SHELL OF A SKI BOOT AND SKI BOOT FITTED THEREWITH

(71) Applicant: ATOMIC Austria GmbH, Altenmarkt im Pongau (AT)

(72) Inventors: Cristiano Benetti, Postioma di Paese (IT); Gerhard Trinkaus, Koeflach (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 14/471,308

(22) Filed: Aug. 28, 2014

(65) Prior Publication Data

US 2015/0059135 A1 Mar. 5, 2015

(30) Foreign Application Priority Data

Aug. 30, 2013 (AT) ..... A 50536/2013

(51) Int. Cl.
*A43C 11/14* (2006.01)

(52) U.S. Cl.
CPC ..... *A43C 11/1413* (2013.01); *A43C 11/142* (2013.01); *A43C 11/144* (2013.01); *Y10T 24/2183* (2015.01)

(58) Field of Classification Search
CPC .. A43C 11/14; A43C 11/142; A43C 11/1413; A43C 11/146; A43B 5/0415; A43B 5/04
USPC ..... 24/70 SK, 69 SK, 71 SK
See application file for complete search history.

(56) References Cited

U.S. PATENT DOCUMENTS

| | | | | | |
|---|---|---|---|---|---|
| 3,258,820 | A * | 7/1966 | Steinberg | A43C 11/1413 | 24/70 R |
| 4,051,611 | A * | 10/1977 | Chalmers | A43C 11/1413 | 24/68 SK |
| 4,424,636 | A * | 1/1984 | Everest | A43C 11/1406 | 24/68 SK |
| 4,596,080 | A * | 6/1986 | Benoit | A43B 5/048 | 36/118.9 |
| 4,651,392 | A * | 3/1987 | Olivieri | A43C 11/142 | 24/68 SK |
| 4,691,454 | A * | 9/1987 | Ottieri | A43B 1/0018 | 24/68 SK |

(Continued)

FOREIGN PATENT DOCUMENTS

| | | | |
|---|---|---|---|
| AT | 506 481 | B1 | 1/2010 |
| DE | 20 2006 009 703 | U1 | 10/2006 |
| EP | 2 198 730 | A1 | 6/2010 |

*Primary Examiner* — Robert J Sandy
*Assistant Examiner* — Rowland Do
(74) *Attorney, Agent, or Firm* — Collard & Roe, P.C.

(57) ABSTRACT

A ski boot buckle for closing the shell of a ski boot includes a toothed plate for mounting on a first flap of the shell of the ski boot. The ski boot buckle also includes a lever system for mounting on another flap of the shell of the ski boot. In the lever system, a fastener is connected in a pivoting arrangement to an operating lever, and the operating lever is accommodated in a pivoting arrangement in a lever retainer. At least one spring element is additionally provided in the lever system for transferring the operating lever into a closed position. Another spring element is provided on the operating lever and can hold the operating lever and the ski boot buckle in the open position.

14 Claims, 4 Drawing Sheets

(56) References Cited

U.S. PATENT DOCUMENTS 5,383,258 A * 1/1995 Nicoletti ..... A43C 11/1406 24/68 SK
5,400,477 A * 3/1995 Marega ..... A43C 11/1406 24/68 SK
5,526,555 A * 6/1996 Battistella ..... A43C 11/1406 24/68 SK
5,575,045 A * 11/1996 Chu ..... A43C 11/146 24/68 SK
5,586,367 A * 12/1996 Benoit ..... A43B 3/0052 24/270
5,669,122 A * 9/1997 Benoit ..... A43B 11/146 24/70 SK
5,715,582 A * 2/1998 Zorzi ..... A43C 11/1406 24/71 SK
5,983,531 A * 11/1999 Chaigne ..... A43C 11/1406 36/50.5
7,011,333 B2 * 3/2006 Pascal ..... A63C 10/06 24/71 SK
8,096,065 B2 * 1/2012 Marechal ..... A43C 11/1433 24/70 SK
8,925,969 B2 * 1/2015 Sonnier ..... F16L 23/003 285/252
2005/0081408 A1 * 4/2005 Chaigne ..... A43B 5/04 36/117.6
2006/0207126 A1 * 9/2006 Pallatin ..... A43B 5/0415 36/50.5
2008/0189922 A1 * 8/2008 Marechal ..... A43C 11/1433 24/68 SK
2008/0263901 A1 * 10/2008 Chaigne ..... A43C 11/142 36/117.1
2012/0297591 A1 * 11/2012 Bozzetto ..... A43C 11/146 24/68 SK
2013/0091674 A1 * 4/2013 Chen ..... A43C 11/146 24/68 SK

* cited by examiner

SKI BOOT BUCKLE FOR CLOSING THE SHELL OF A SKI BOOT AND SKI BOOT FITTED THEREWITH

CROSS REFERENCE TO RELATED APPLICATIONS

Applicant claims priority under 35 U.S.C. §119 of Austrian Application No. A 50536/2013 filed on Aug. 30, 2013, the disclosure of which is incorporated by reference.

BACKGROUND OF THE INVENTION

1. Field of the Invention

The invention relates to a ski boot buckle for closing the shell of a ski boot and a ski boot fitted with this ski boot buckle, as defined in claims 1 and 13.

2. The Prior Art

AT 506 481 B1 discloses a ski boot buckle comprising a toothed plate, a fastener, a connecting piece and a lever which is mounted in a lever retaining means and can be held in its open position by means of a spring element with a predefined retaining force. The toothed plate is designed so that the fastener can be hooked in or fastened both in the pulling and pushing direction and the fastener, which together with the connecting piece establishes a pivotable connection to the lever, is fastened to the toothed plate and is able to apply a pushing force in order to push on the boot shell. As a result, when pushing back or on the lever, a first boot flap connected to the toothed plate and another boot flap connected to the lever retaining means are spaced apart or pushed apart from one another. The buckle is placed in a held-open position as a result because said spring element is provided in the form of a resilient tongue, which is mounted on the lever retaining means. This resilient tongue on the lever retaining means acts on the lever in such a way that when a specific pivot angle position has been exceeded, the lever is prevented from tipping back into the closed position of its own accord. Due to the fact that the lever has a contoured or cam-type shaping in its end portion lying closest to the lever retaining means, on which end portion the spring element acts, the lever can be fixed in its open position by means of the resilient tongue with a retaining force that can be manually overcome. In order to close the buckle, the lever has to be pushed in the direction of its closed position, whereby the lever forces the resilient tongue, tenses the fastener, pulls on the toothed plate and thus makes the overlap between the first and the other boot flap bigger so that the holding capacity of the boot shell is reduced. When a pivot position is exceeded during the operation of closing the lever, the lever is held in its closed position—in a manner known per se—and the ski boot buckle remains closed with the correspondingly desired tensioning or clamping force.

EP 2 198 730 A1 describes a ski boot buckle comprising a toothed plate, a fastener, a connecting piece and a lever which is mounted so as to be pivotable in a lever retaining means. Mounted on this lever is a ring-shaped or bow-shaped retaining element. The toothed plate is designed so that the fastener is able to hook in both in the pulling and pushing direction so that the fastener is able to exert both pulling and pushing forces on the toothed plate. An open position of the buckle is achieved due to the fact that the ring-shaped or bow-shaped retaining element latches or positively engages in an undercut or groove on the lever retaining means, as a result of which the lever is fixed in its open position. To enable the buckle to be closed again, its lever must firstly be opened to a slightly greater extent to allow the retaining element to be manually released from its latched position relative to the undercut on the lever retaining means. In this respect, the lever must be specifically pivoted beyond its open position to enable the positive engagement with the lever retaining means to be released.

The disadvantage of the design described in AT 506 481 B1 is that because of the specified arrangement of the spring element and the fact that it is provided in the form of a resilient tongue, there is a potential danger point. In particular, there is an increased possibility of injury to the user because during the process of closing or opening the ski boot buckle, the user can jam the fingers between the spring element and lever retaining means or knock against the resilient tongue.

The disadvantage of the design described in EP 2 198 730 A1 is that another component in the form of a ring-shaped or bow-shaped retaining element is necessary in order to fix the operating lever as and when necessary. The use of this retaining element increases the complexity of the buckle, as a result of which it is susceptible to breakage. Furthermore, the operating simplicity of the buckle in terms of a conventional ski boot can no longer be guaranteed because the retaining element has to be manually moved out of its engaged position in order to close the buckle. To this end, a person wanting to pull the ski boot on or off has to perform an additional manipulation. The retaining element is also awkward, especially if the ski boot buckle is operated whilst wearing ski gloves, and operation wearing gloves is made very difficult.

SUMMARY OF THE INVENTION

The underlying objective of this invention is to propose a ski boot buckle which is capable of remaining in the open position and not engaged with the toothed plate when pulling the ski boot on or pulling it off or also during use of the ski boot, and it should be possible to produce the corresponding design as cost-effectively as possible whilst nevertheless offering a high degree of comfort in terms of operation. Another objective is to propose a ski boot that meets higher demands in terms of comfort and functionality.

This objective is achieved by the invention on the basis of the features described herein.

The invention proposes a ski boot buckle for closing the shell of a ski boot, comprising a toothed plate for mounting on a first flap of the shell of the ski boot and a lever system for mounting on another flap of the shell of the ski boot. In the lever system, a fastener is connected to an operating lever in a pivoting arrangement and the operating lever is accommodated in a lever retaining means in a pivoting arrangement. Also provided in the lever system is at least one spring element for transferring the operating lever into a closed position. Another spring element is provided or disposed on the operating lever, by means of which other spring element the operating lever respectively the ski boot buckle can be held in the open position.

One advantage of the design proposed by the invention resides in the fact that by positioning the other spring element directly on the operating lever, the ski boot buckle can be designed so that there is as far as possible no danger point at which a user of the ski boot might be susceptible to injury due to clamping or grazing. In addition, the corresponding spring element is based on the simplest design possible from a construction point of view so that it can be manufactured inexpensively and can be optimally mounted on the operating lever or even designed as an integral part of the operating lever. Furthermore, no additional manipulation is needed by the user for the operation of closing the ski boot buckle from its open position and instead, the ski boot buckle can simply be pushed to in the same way as a conventional ski boot buckle. As a result, handling is as simple as possible and the ski boot can be pulled on or pulled off again with ease. In particular, even if wearing gloves, as is often the case when using ski boots, the most comfortable and effortless operation or control of the ski boot buckle is guaranteed. The ski boot buckle proposed by the invention and the ski boot fitted with it therefore avoids spring elements which constitute potential danger points due to their shape or positioning during the process of closing or opening the ski boot buckle. Furthermore, the specified ski boot buckle can be made to a simple and robust design in terms of construction to avoid potential breakage points and at the same time increases user-friendliness.

In particular, the other spring element may be displaceable by pivoting the operating lever into or past a predefined pivot angle position with the lever retaining means in and out of engagement or in and out of resilient interaction. The advantage of this is that the operating lever can be operated in the same way as a conventional ski boot buckle without additional manipulations being necessary. When the ski boot buckle is in the closed position, the spring element is not or is only marginally in engagement with or interacting with the lever retaining means and the spring element is therefore not pre-tensed or is barely under load. When the operating lever of the ski boot buckle is then pivoted or opened beyond a predefined pivot angle position, the other spring element pushes the operating lever into the open position and the operating lever is resiliently retained as a result so that the operating lever is able to remain in this open position. In order to close the ski boot buckle, the operating lever merely has to be moved or pushed into its closed position. When it is pivoted beyond a defined pivot angle position again or moved there, the other spring element forces or pushes the operating lever into the closed position.

Based on one advantageous embodiment, the other spring element is provided in the form of an elastically flexible cam which is disposed eccentrically with respect to a pivot axis of the operating lever and provided on an end portion of the operating lever remote from an operating portion of the operating lever. This results in the simplest possible yet practical structural design, which is relatively inexpensive to make, thereby offering an optimized cost-benefit ratio for the specified ski boot buckle.

In particular, an open position of the ski boot buckle can be assumed or activated by the user of the ski boot using the specified ski boot buckle, which open position permits the widest possible volume expansion or circumferential widening of the ski boot without the user totally losing the hold in the ski boot. In particular, the ski boot buckle or its fastener can be set to the maximum opening width relative to the toothed plate and the open position of the ski boot buckle or operating lever is assumed at the same time, as a result of which the user of the ski boot still feels a restraint or a certain retention, especially in the cuff region of the ski boot. This is of particular advantage in connection with touring ski boots because the maximum adjustment path or adjustment range between the fixed state of the foot in the boot and a particularly loose fit of the foot in the ski boot with some relative movement can be made bigger. Especially with regard to the deployment states of (i) the pulling on setting versus (ii) the pulling off setting, a bigger adjustment range can be achieved and with it optimized adaptability, which is of particular advantage in connection with touring ski boots when participating in touring ski sports.

Based on one practical embodiment, the other spring element may be designed with a U-shaped cross-section comprising a first and second arm, by means of which the other spring element is retained on the operating lever, and a base portion connecting the two arms projects out relative to a lever arm of the operating lever remote from the operating portion of the operating lever. In particular, a U-shaped spring element can be provided which is fitted on the operating lever and can thus guarantee that the operating lever remains in its open position. The advantage of opting for a U-shaped design for the construction of the other spring element is that the other spring element partially surrounds the operating lever, as a result of which the force transmitted by the other spring element to the operating lever is optimum, relatively speaking, due to the positive fit. In addition, this enables a long service life of the other spring element to be achieved because there are no points that are subjected to high loads.

It may also be of practical advantage if the base portion is provided with an arcuate contact surface which can be moved into and out of contact with the lever retaining means. The advantage of an arcuate contact surface is that wear occurring on the lever retaining means due to relative movements between the base portion of the other spring element and lever retaining means can be minimized because there are no sharp edges. Consequently, the ski boot buckle will exhibit the most constant possible functional behavior for a long time.

Based on one advantageous embodiment, the contact surface projects out relative to the lever arm by 2 to 10 mm, in particular between 3 and 6 mm, preferably 4 to 5 mm. These pairs of values are of particular advantage because they enable the desired functionality to be reliably achieved whilst at the same time keeping the requisite mounting space relatively small.

It may also be of practical advantage if an elastic deformation path of the other spring element during the transfer between the closed and open position—and vice versa—is between 0.5 and 4 mm, in particular between 1 and 3 mm, preferably between 1.5 and 2.5 mm. The advantage of this is that with these deformation paths, a sufficient spring force induced by the elasticity of the spring element can be applied, even if the spring element is made from plastic.

In an alternative embodiment, the operating lever is directly connected to the fastener or is connected to the fastener by means of a connecting piece and the other spring element is provided in the form of a catch lug by means of which the fastener can be retained in an inactive position spaced at a distance apart from the toothed plate and out of engagement. The advantage of this is that the other spring element may be of a relatively small design and can be integrated in the operating lever relatively optimally. As a result of this design of the other spring element, the fastener of the ski boot buckle can be constantly held out of engagement with the toothed plate having assumed a raised inactive position. In particular, the other spring element prevents the fastener from engaging in the toothed plate as a result.

In this connection, it is of practical advantage if a retaining force of the catch lug can be overcome without the need for tools so that the fastener can be manually transferred from its inactive position into an active position contacting the toothed plate—and vice versa. In one advantageous embodiment, the retaining force of the catch lug is set so that it is able to guarantee the holding-open function but the ski boot wearer does not have to apply a strong force to the operating lever in order to close the ski boot buckle.

Based on one practical embodiment, the catch lug defining the other spring element is provided in the form of at least one boss-type protuberance within the pivot path between the operating lever and fastener or connecting piece. One advantage of such a design resides in the fact that it can be easily implemented and complexity in terms of manufacture can be kept to a minimum. In addition, such a design may advantageously be used if the spring element provided as a means of closing or establishing contact of the operating lever of the ski boot buckle on the shell of the ski boot is disposed between the operating lever and the connecting piece or fastener.

It may also be of practical advantage if the other spring element is mounted on the operating lever by means of a connecting bolt between the operating lever and the fastener or connecting piece and/or by means of a connecting bolt between the operating lever and lever retaining means. The advantage of this is that these connecting bolts are provided in the ski boot buckle anyway, which means that no separate fixing elements are needed for the other spring element.

For practical purposes, these connecting bolts constitute the pivot axes between the relevant parts.

Furthermore, the lever retaining means may be made from a first material, preferably metal, and the other spring element is made from another material, preferably plastic. The advantage of this is that because the other spring element is made from plastic, it can be easily and inexpensively produced by a casting process. In addition, this pairing of metal and plastic means that even if the ski boot buckle is opened and closed frequently, the occurrence of wear on the two parts remains low.

The second above-mentioned objective of the invention is achieved by means of a ski boot as described herein. The technical effects and advantageous effects achieved as a result may be found in the parts of the description below.

BRIEF DESCRIPTION OF THE DRAWINGS

To provide a clearer understanding, the invention will be described in more detail below with reference to the appended drawings.

These are highly simplified, schematic diagrams illustrating the following.

DETAILED DESCRIPTION OF THE PREFERRED EMBODIMENTS

Figure 1:
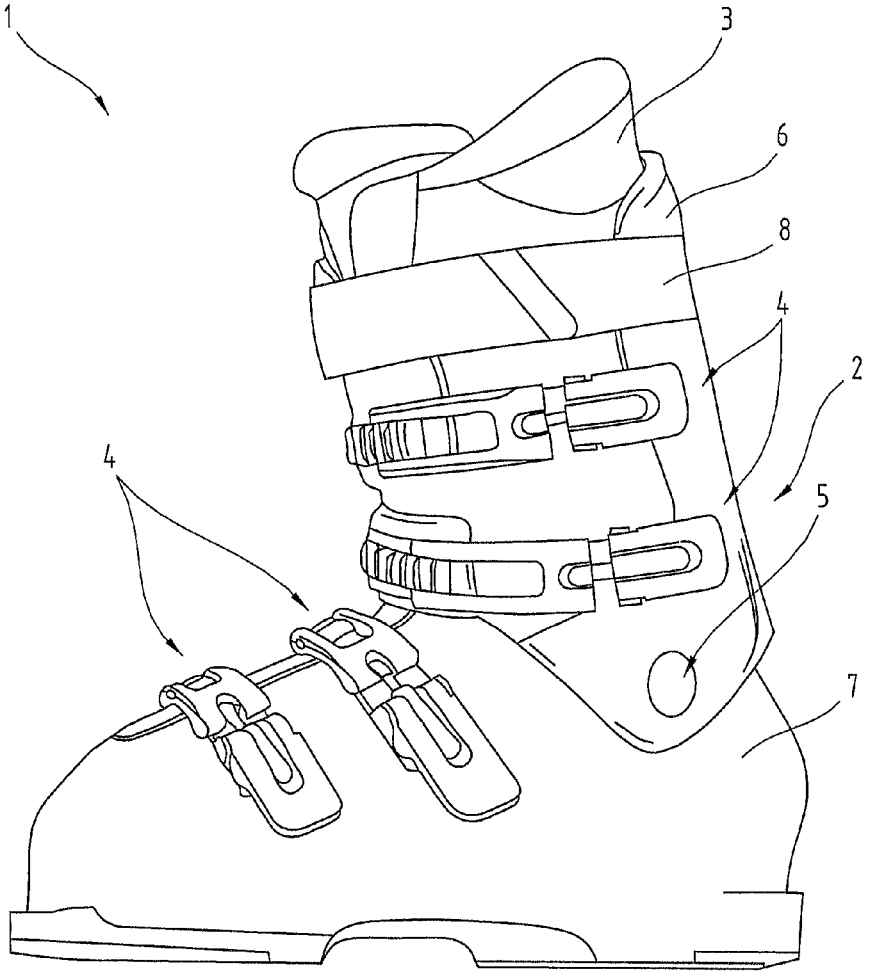
FIG. 1 a perspective view of a ski boot.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 is a perspective view illustrating a ski boot 1. The ski boot essentially comprises a shell 2 and an inner boot 3. Optionally, the inner boot 3, which is made from a soft plastic material, may be removed from the shell 2, which is made from a relatively hard and dimensionally stable plastic material. Based on a preferred embodiment, such a ski boot 1 is a touring ski boot, in which case the inner boot 3 may typically be laced. However, the ski boot 1 may also be an alpine ski boot, in which case the inner boot 3 does not usually have a separate closing or fixing means.

In both embodiments of the ski boot 1, at least some portions of the inner boot 3 are accommodated or surrounded by the shell 2. A foot accommodated by the inner boot 3 can be retained in the inner boot 3 by reducing the holding capacity of the shell 2 or inner boot 3. The holding capacity of the shell 2 is reduced by means of ski boot buckles 4 and, depending on the model of the ski boot 1, a different number of ski boot buckles 4 may be provided on the shell 2. In the embodiment illustrated as an example, the shell 2 comprises a shaft 6 and a bottom shell 7 which are connected to one another in an articulated arrangement by means of an articulated joint 5. By way of example, two ski boot buckles 4 are provided respectively on the bottom shell 7 and on the shaft 6. In addition, a Velcro strap 8 may be provided on the shaft 6, by means of which a foot accommodated by the ski boot 1 can be further stabilized.

Figure 3:
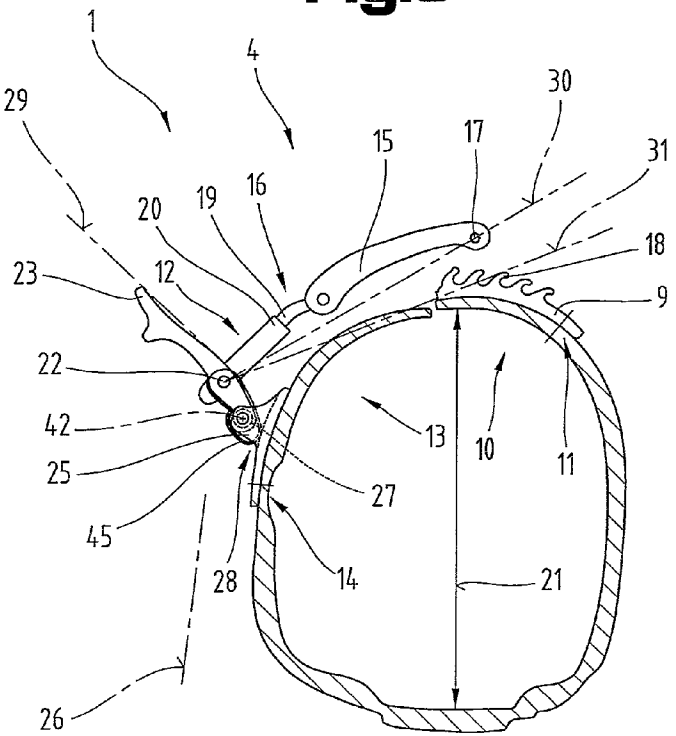
FIG. 3 the shaft and the ski boot buckle illustrated in FIG. 2 in an open position.
Figure 2:
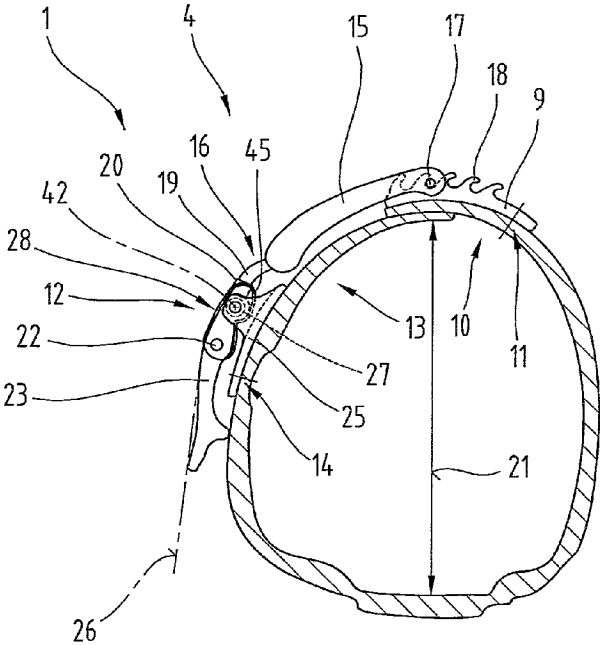
FIG. 2 a section through the shaft of the ski boot with a ski boot buckle in the closed position.

FIGS. 2, 3 illustrate a section through the shaft 6 of a ski boot 1 with a ski boot buckle 4. The ski boot buckle 4 comprises a toothed plate 9 which is mounted on a first flap 10 of the shell 2, for example a flap of the shaft 6. The toothed plate 9 may be mounted on the first flap 10 by means of a first fixing means 11, which fixing means 11 may be provided in the form of a rivet or screw, for example. It would also be conceivable for the toothed plate 9 to be glued to the first flap 10 or molded onto it. The ski boot buckle 4 further comprises a lever system 12, which is mounted on another flap 13 of the shell 2, specifically the shaft 6. Here too, it would be possible for the lever system 12 to be mounted on the other flap 13 by means of a different fixing means 14 or to glue or partially injection-mold it into the plastic.

The lever system 12 has a fastener 15, which is disposed on a connecting piece 16. The fastener 15 has a bolt portion 17 which is able to engage in a tooth 18 of the toothed plate 9. Instead of a fastener 15 based on a bow-type design, the fastener 15 may also be based on a T-shaped design as seen from above. The connection between the fastener 15 and connecting piece 16 may be either rigid or articulated.

The connecting piece 16 may either be of an integral or multi-part design. In the case of a multi-part design, the connecting piece 16 may be split into a spindle 19 and a shaft 20 accommodating the spindle 19. Rotating the spindle 19 on an axis of rotation relative to the shaft 20 enables the length of the connecting piece 16 to be set, thereby enabling the closing width 21 to be finely adjusted. The closing width 21 can be roughly adjusted by the bolt portion 17 of the fastener 15, which is able to engage in different teeth 18 of the toothed plate 9 disposed one after the other.

The connecting piece 16 together with the fastener 15 is connected to the operating lever 23 of the ski boot buckle 4 in an articulated arrangement via a first connecting bolt 22. The operating lever 23 is in turn connected to the lever retaining means 25 by another connecting bolt 24—FIGS. 4*a*, 4*b*—to permit a pivoting movement. The lever retaining means 25 is a lever retainer of the lever system 12 and is connected to the other flap 13.

The operating lever 23 is the element which the user of the ski boot 1 operates in order to close or open the ski boot buckle 4. In order to hold the operating lever 23 in a closed position 26, a spring element 27 is disposed around either the first connecting bolt 22 or around the other connecting bolt 24. As illustrated in this instance, this spring element 27 may be a torsion spring or alternatively also a simple leaf spring. It would naturally also be possible to provide a spring element on both connecting bolts 22, 24, and a combination of torsion spring and leaf spring would also be possible. When the ski boot buckle 1 is in the tensed state, pivot angle positions or movements beyond dead center positions are also used in the kinematics or closing mechanism as a means of holding the ski boot buckle 4 in a pre-tensed closed position 26 and preventing an automatic release.

Using the spring element 27 means that the operating lever 23 is also held in its closed position 26 when the ski boot buckle 4 is not pre-tensioned or is in the non-tensed state. The bolt portion 17 of the fastener 15 typically engages in a tooth 18 of the toothed plate 9 at the same time.

In the case of a conventional ski boot buckle, this means that the closing width 21 of the shaft 6 is not changed due to pressure in the interior of the ski boot 1 or shaft 6, in particular cannot be made larger. Typically, the ski boot wearer must move the fastener 15, respectively the bolt portion 17 out of engagement with the teeth 18 by applying manual force when he wants to pull the ski boot on or pull it off. This is very troublesome and awkward, especially in cold temperatures and if the fit of the ski boot 1 is tight. It is usually also necessary to use the hands to widen the shaft 6.

In order to improve and extend the functionality of the ski boot buckle 4 and the ski boot 1 fitted with it, an additional spring element 28 is mounted on the operating lever 23 by means of which another spring element 28 of the operating lever 23 can be held in an open position 29. This enables the closing width 21 to be made larger and the maximum adjustment range of the ski boot buckle 4 to be made larger. In particular, when some of the ski boot buckles 4 are held in an open position 29, it is easier to make allowance for greater freedom of movement for the user's leg or foot when wearing the ski boot 1. This is the case in particular if the fastener 15 or its bolt portion 17 is engaged behind one of the teeth 17 or hooked into the toothed plate 9 (not illustrated in FIG. 3). In particular, this results in maximum freedom of movement for the foot and lower leg whilst at the same time preventing full opening of the flaps 10, 13 of the shaft 6 so that the foot does not lose its hold on the ski boot 1. In a manner known per se, the bolt portion 17 can also be moved out of engagement with the teeth 18 by the user to make it easier to step into or out of the ski boot 1.

When the ski boot buckle 4 is in the position illustrated in FIG. 3, the operating lever 23 is in the open position 29. As illustrated in FIG. 3, the fastener 15 is in its inactive position 30 from which it can be pivoted into its active position 31 (not illustrated). In the active position 31, the bolt portion 17 sits in engagement with a tooth 18 of the toothed plate 9. As may also readily be seen in FIG. 3, the closing width 21 in the shaft 6 is bigger than the comparative value when the ski boot 1 is closed, which is illustrated in FIG. 2. This makes it easier to pull the ski boot 1 on and off. When the operating lever 23 has assumed the open position 29 and the fastener 15 has simultaneously assumed the active position 31 on the tooth 18 of the toothed plate 9 lying closest to the lever system 12, it may nevertheless be of advantage to prevent the flaps 11, 13 from opening or moving apart in order to obtain greater or maximized ability to maintain a hold in the boot interior. This comfort setting may be of particular advantage in the case of touring ski boots 1. This is especially so if a light climb lies ahead or during rest periods.

Figure 4A:
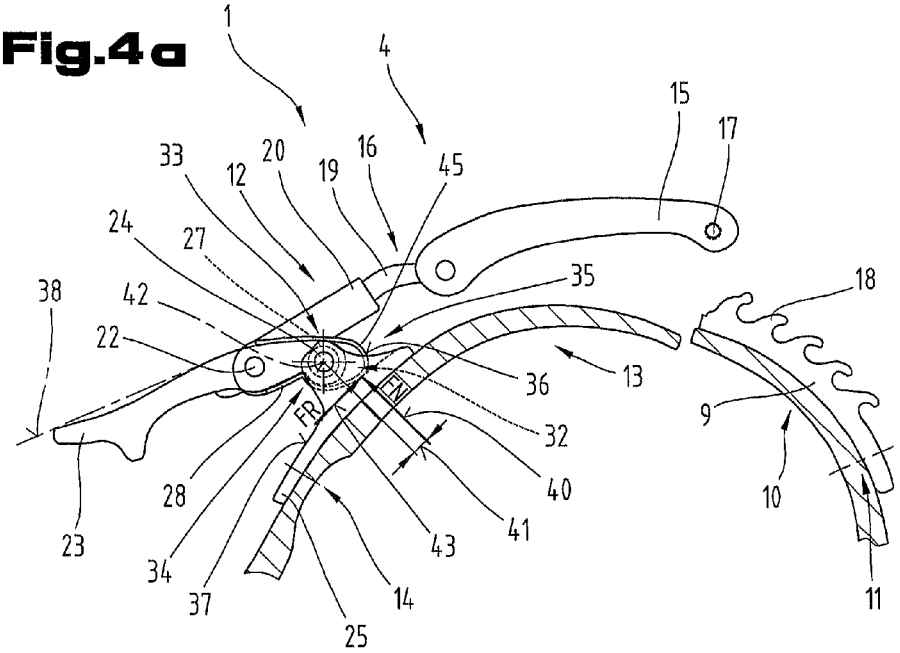
FIG. 4*a* a section through the ski boot shaft with the ski boot buckle, the operating lever of which sits at the start of an interaction with its lever retaining means.
Figure 4B:
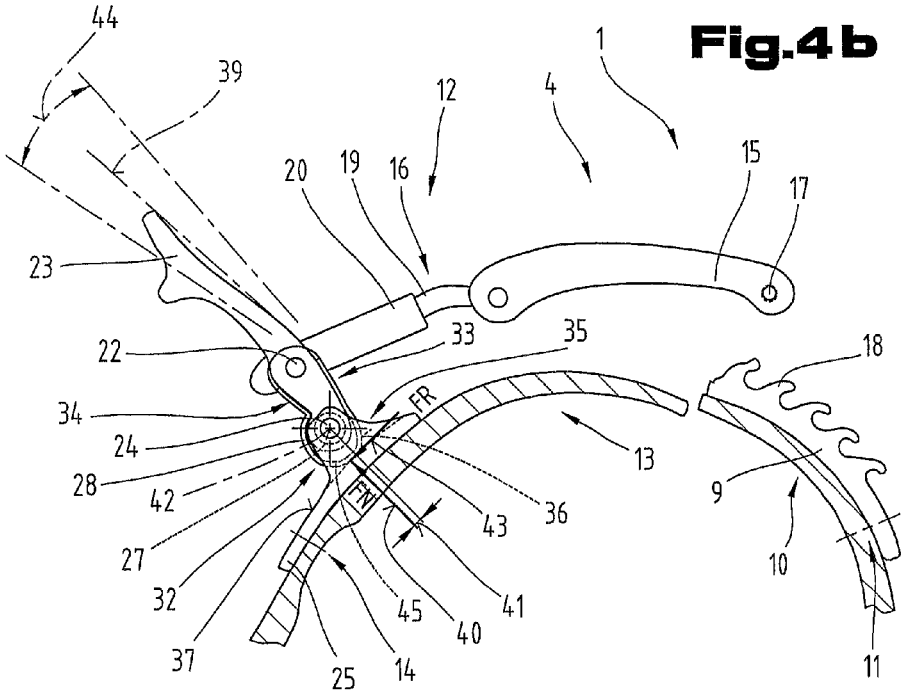
FIG. 4*b* the ski boot buckle illustrated in FIG. 4*a*, where its operating lever is automatically held in the open position when in this pivot position.

FIGS. 4*a* and 4*b* illustrate detailed views of the ski boot buckle 4, where the ski boot buckle 4 has been placed in the opening phase by the ski boot wearer. These detailed views illustrate an advantageous embodiment of the other spring element 28 on the operating lever 23. As may be seen, the other spring element 28 is disposed around the lever arm 32 of the operating lever 23 or is at least partially disposed on the lever arm 32 of the operating lever 23. The lever arm 32 is at least partially accommodated in the lever retaining means 25 and constitutes the end portion of the operating lever 23 remote from the operating portion of the operating lever 23. Accordingly, the connecting bolt 24 or the pivot axis 42 defined by it may be regarded as a virtual boundary between the operating portion and lever arm 23.

In this advantageous embodiment, the other spring element 28 comprises a first arm 33 and a second arm 34, which lie respectively on oppositely lying sides of the lever arm 32. The two arms 33 and 34 form an integral U-fastener in conjunction with a base portion 35.

As a result of this arrangement of the two arms 33 and 34 and the base portion 35, the other spring element 28 assumes a U-shape as viewed from the side. Disposed on the side of the other spring element 28 facing the lever retaining means 25 is a contact surface 36. During the course of pivoting the operating lever 23, this contact surface 36 is brought into contact with another contact surface 37 on the lever retaining means 25 and effects a relative movement. A relative movement of the two contact surfaces 36, 37 is prevented by frictional forces during the pivoting movement of the operating lever 23. Due to the described geometry of the spring element 28, it has a fault-free and long service life.

In FIG. 4*a*, the operating lever 23 is raised to the degree that the contact surface 36 of the other spring element 28 and the other contact surface 37 of the lever retaining means 25 are lightly touching one another. As a result, the other spring element 28 is minimally elastically deformed, as a result of which a force or torque is exerted on the lever system 12 by the other spring element 28, as illustrated in FIG. 4*a*, which lever system will be described in more detail in conjunction with FIG. 4*b*.

FIG. 4*b* illustrates the operating lever 23 in a different pivot angle position 39 in which the other spring element 28 is elastically deformed. The elastic deformation of the other spring element 28 generates a pressure load 40 which occurs between the other contact surface 37 of the lever retaining means 25 and the contact surface 36 of the other spring element 28. The pressure load 40 acts at a certain lever distance 41 from the pivot axis 42 of the other connecting bolt 24 and operating lever 23. This creates a torque by means of which the operating lever 23 tends to open wider. Opposing this torque is another torque, which is applied to the operating lever 23 by the spring element 27 and a torque generated by the frictional force 43 between the contact surfaces 36 and 37.

If it were not for the frictional force 43, a different pivot angle position 39 would be assumed in which the torque generated by the other spring element 28 as well as the torque generated by spring element 27 would not occur. With just the smallest deviation from this different pivot angle position 39, the lever system 12 would tip either into the open position 29 or into the closed position 26.

As a result of the frictional force 43, however, a pivot angle range 44 is created in which the lever system 12 remains in a stable state. Outside of this pivot angle range 44, a tipping movement into the open position 29 or into the closed position 26 of the operating lever 23 takes place.

The other spring element 28 essentially acts as an elastically flexible cam 45, which is disposed eccentrically with respect to the pivot axis 42 of the operating lever 23 and in an end portion of the operating lever 23 remote from the operating portion of the operating lever 23. Such an eccentric element in the form of an intrinsically elastic cam 45 is inexpensive to produce, robust and functionally durable.

Figure 5:
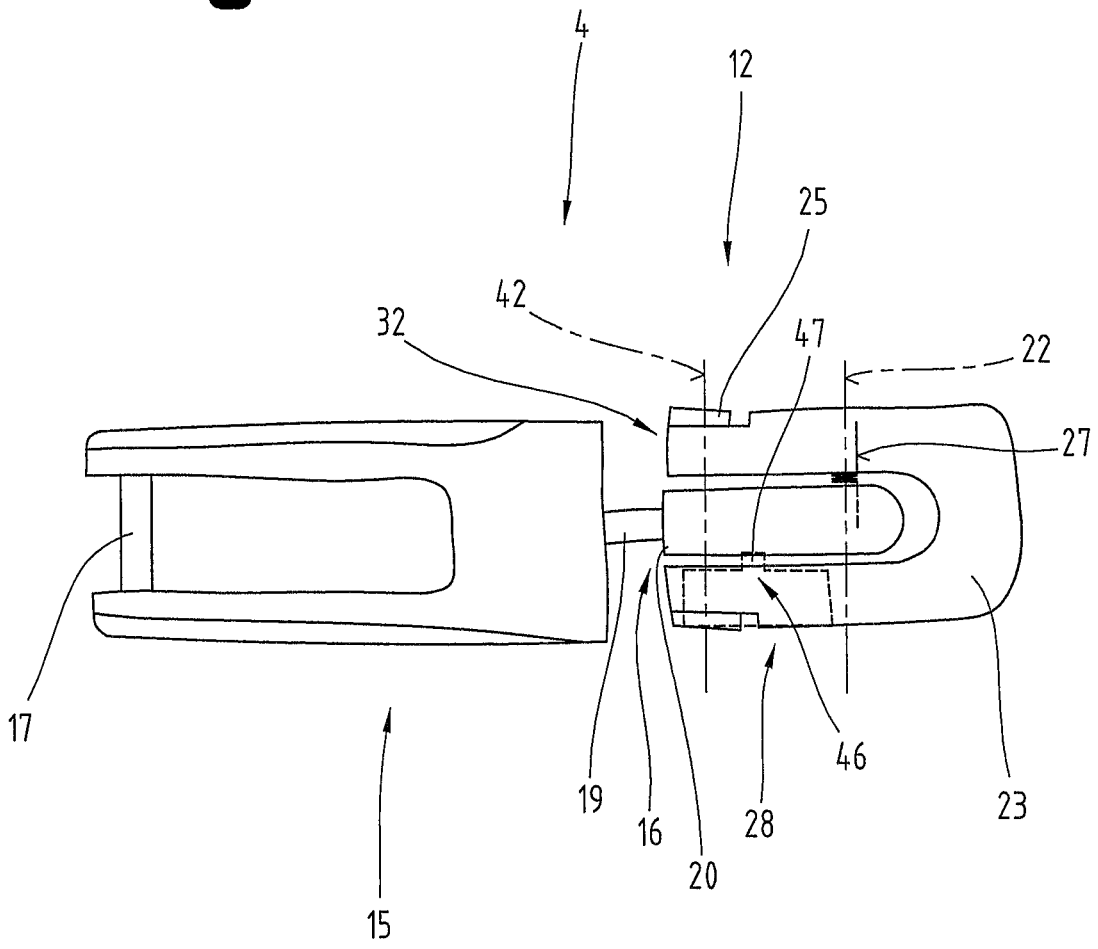
FIG. 5 a plan view of a ski boot buckle based on a different embodiment for activating and deactivating a persistent open position of the operating lever.

FIG. 5 illustrates another embodiment of the ski boot buckle 4 which may be construed as an independent solution in its own right, the same reference numbers and component names being used to denote parts that are the same as those described in conjunction with the previous drawings. To avoid unnecessary repetition, reference may be made to the detailed description of the drawings given above.

In the embodiment of a ski boot buckle 4 illustrated in FIG. 5, the other spring element 28 is not disposed on the lever arm 32 of the operating lever 23 and instead, the other spring element 28 is provided in the form of a catch lug 46 which can be moved into engagement with or which interacts with the connecting piece 16 or with the fastener 15 and thus keeps the lever system 12 in its open position. In the embodiment illustrated, the catch lug 46 is designed as a boss-type protuberance 47. Such a protuberance 47 is simple to produce and, as well as being highly robust and durable, also offers optimum functionality. This embodiment is particularly practical if the spring element 27 is disposed between the fastener 15 or connecting piece 16 and the operating lever 23. Again with this embodiment, the other spring element 28 may be mounted on the operating lever 23 by means of either the first connecting bolt 22 or by means of the other connecting bolt 24 or alternatively the two connecting bolts 22, 24.

The embodiments illustrated as examples represent possible variants of the ski boot buckle 4, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

Furthermore, individual features or combinations of features from the embodiments described and illustrated as examples may be construed as independent inventive solutions in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 1 to 5 constitute independent solutions proposed by the invention in their own right. The objectives and associated solutions proposed by the invention may be found in the detailed descriptions of these drawings.

For the sake of good order, it should finally be pointed out that in order to provide a clearer understanding of the structure of the ski boot buckle 4, it and its constituent parts have been illustrated out of scale to a certain extent and/or on an enlarged and/or reduced scale.

| List of reference numbers | |
|---|---|
| 1 | Ski boot |
| 2 | Shell |
| 3 | Inner shoe |
| 4 | Ski boot buckle |
| 5 | Articulated joint |
| 6 | Shaft |
| 7 | Bottom shell |
| 8 | Velcro strap |
| 9 | Toothed plate |
| 10 | First flap |
| 11 | First fixing means |
| 12 | Lever system |
| 13 | Other flap |
| 14 | Other fixing means |
| 15 | Fastener |
| 16 | Connecting piece |
| 17 | Bolt portion |
| 18 | Tooth |
| 19 | Spindle |
| 20 | Shaft |
| 21 | Closing width |
| 22 | First connecting bolt |
| 23 | Operating lever |
| 24 | Other connecting bolt |
| 25 | Lever retaining means |
| 26 | Closed position |
| 27 | Spring element |
| 28 | Other spring element |
| 29 | Open position |
| 30 | Inactive position |
| 31 | Active position |
| 32 | Lever arm |
| 33 | First arm |
| 34 | Second arm |
| 35 | Base portion |
| 36 | Contact surface |
| 37 | Other contact surface |
| 38 | Pivot angle position |
| 39 | Different pivot angle position |
| 40 | Pressure load |
| 41 | Lever distance |
| 42 | Pivot axis |
| 43 | Frictional force |
| 44 | Pivot angle range |
| 45 | Cam |
| 46 | Catch lug |
| 47 | Boss-type protuberance |

The invention claimed is:

1. A ski boot buckle for closing the shell of a ski boot, the ski boot buckle comprising a toothed plate for mounting on a first flap of the shell of the ski boot, and a lever system for mounting on another flap of the shell of the ski boot, wherein the lever system comprises a lever retainer, an operating lever, and a fastener, the fastener being connected in a pivoting arrangement to the operating lever, wherein the operating lever is accommodated in a pivoting arrangement in the lever, retainer, wherein the lever system further comprises at least one spring element configured to transfer the operating lever into a closed position, wherein another spring element is provided on the operating lever, wherein the other spring element is configured to hold and resiliently retain the operating lever of the ski boot buckle in an open position when the operating lever of the ski boot buckle is opened beyond a predefined pivot angle position, so that the operating lever is able to remain in the open position.

2. The ski boot buckle according to claim 1, wherein the other spring element can be moved into or via a predefined pivot angle position in and out of resilient interaction with the lever retainer by pivoting the operating lever.

3. The ski boot buckle according to claim 1, wherein the other spring element is provided in the form of an elastically flexible cam which is disposed eccentrically with respect to a pivot axis of the operating lever and in an end portion of the operating lever remote from an operating portion of the operating lever.

4. The ski boot buckle according to claim 1, wherein the other spring element is of a U-shaped design in cross-section and comprises a first arm and a second arm retaining the other spring element on the operating lever, and a base portion connecting the first arm to the second arm projects out beyond a lever arm of the operating lever remote from the operating portion of the operating lever.

5. The ski boot buckle according to claim 4, wherein the base portion forms an arcuate contact surface which can be moved into and out of contact with the lever retainer.

6. The ski boot buckle according to claim 5, wherein the arcuate contact surface projects out beyond the lever arm by between 2 and 10 mm.

7. The ski boot buckle according to claim 1, wherein an elastic deformation path of the other spring element during the transfer between the closed and open position—and vice versa—is between 0.5 and 4 mm.

8. The ski boot buckle according to claim 1, wherein the operating lever is connected to the fastener directly or is connected to the fastener via a connecting piece, wherein the other spring element is provided in the form of a catch lug, and wherein the catch lug can hold the fastener in an inactive position out of engagement at a distance apart from the toothed plate.

9. The ski boot buckle according to claim 8, wherein a retaining force of the catch lug can be overcome without the need for tools so that the fastener can be transferred from its inactive position into an active position in contact with the toothed plate—and vice versa—by manual operation.

10. The ski boot buckle according to claim 8, wherein the catch lug is provided in the form of at least one boss-type protuberance within the pivot path between the operating lever and fastener or connecting piece.

11. The ski boot buckle according to claim 1, wherein the other spring element is mounted on the operating lever via a first connecting bolt between the operating lever and the fastener or connecting piece and/or via another connecting bolt between the operating lever and the lever retainer.

12. The ski boot buckle according to claim 1, wherein the lever retainer is made from a material of a first type, and the second spring element is made from a material of a second type, and wherein the first type is different from the second type.

13. The ski boot comprising a shell of hard plastic, as well as at least one ski boot buckle for varying the holding capacity of the shell, wherein the at least one ski boot buckle is as defined in claim 1.

14. A ski boot buckle for closing the shell of a ski boot, the ski boot buckle comprising:

a toothed plate for mounting on a first flap of the shell of the ski boot, and a lever system for mounting on another flap of the shell of the ski boot, wherein the lever system comprises a lever retainer, an operating lever, and a fastener, the fastener being connected in a pivoting arrangement to the operating lever, wherein the operating lever is accommodated in a pivoting arrangement in the lever retainer, wherein the lever system further comprises at least one spring element configured to transfer the operating lever into a closed position, wherein another spring element is provided on the operating lever, wherein the other spring element can hold the operating lever and the ski boot buckle in an open position, wherein the other spring element is of a U-shaped design in cross-section and comprises a first arm and a second arm, wherein the first arm and the second arm retain the other spring element on the operating lever, wherein a base portion connecting the first arm to the second arm projects out beyond a lever arm of the operating lever remote from the operating portion of the operating lever, and wherein the base portion forms an arcuate contact surface which can be moved into and out of contact with the lever retainer.

* * * * *

UNITED STATES PATENT AND TRADEMARK OFFICE

CERTIFICATE OF CORRECTION

PATENT NO. : 9,339,083 B2
APPLICATION NO. : 14/471308
DATED : May 17, 2016
INVENTOR(S) : Benetti et al.

It is certified that error appears in the above-identified patent and that said Letters Patent is hereby corrected as shown below:

In the Claims

In Column 10, line 54, (Claim 1) after the word "lever" please delete: ",".

Signed and Sealed this
Ninth Day of August, 2016

Michelle K. Lee

Michelle K. Lee
*Director of the United States Patent and Trademark Office*